US007963002B2

(12) United States Patent
Hanigan

(10) Patent No.: US 7,963,002 B2
(45) Date of Patent: Jun. 21, 2011

(54) HINGE

(75) Inventor: Nicholas James Hanigan, Darwin (AU)

(73) Assignee: Rolling Hinge Pty Limited, Darwin (AU)

( * ) Notice: Subject to any disclaimer, the term of this patent is extended or adjusted under 35 U.S.C. 154(b) by 373 days.

(21) Appl. No.: 11/922,975

(22) PCT Filed: Jun. 30, 2006

(86) PCT No.: PCT/AU2006/000929

§ 371 (c)(1),
(2), (4) Date: May 21, 2008

(87) PCT Pub. No.: WO2007/002998

PCT Pub. Date: Jan. 11, 2007

(65) Prior Publication Data

US 2009/0133224 A1 May 28, 2009

(30) Foreign Application Priority Data

Jun. 30, 2005 (AU) ..... 2005903454

(51) Int. Cl.
*E05D 5/00* (2006.01)

(52) U.S. Cl. ..... 16/382; 16/366

(58) Field of Classification Search ..... 16/382, 16/387, 366, 367, 355, 356, 239, 282, 287, 16/294, 302

See application file for complete search history.

(56) References Cited

U.S. PATENT DOCUMENTS

| | | | | |
|---|---|---|---|---|
| 1,100,684 | A * | 6/1914 | Stoakes | 16/367 |
| 1,441,350 | A | 3/1919 | Herrman | |
| 1,903,379 | A * | 4/1933 | Hall | 16/367 |
| 4,343,065 | A | 8/1982 | Liber | |
| 5,337,452 | A * | 8/1994 | LeBlanc et al. | 16/367 |
| 5,362,063 | A | 11/1994 | Cummings | |
| 7,007,346 | B2 * | 3/2006 | Hoffman | 16/367 |
| 2004/0168591 | A1 | 9/2004 | Lynton | |

FOREIGN PATENT DOCUMENTS

GB 313495 A 4/1930

* cited by examiner

*Primary Examiner* — William L. Miller
(74) *Attorney, Agent, or Firm* — Woodcock Washburn LLP

(57) ABSTRACT

A hinge comprising two pivoting elements adapted to hingedly join two articles, each pivoting element including attachment means for attaching to an article; wherein when attached to the two articles the hinge is rotatable with respect to the articles.

8 Claims, 6 Drawing Sheets

HINGE

FIELD OF THE DISCLOSURE

The disclosure relates to a hinge.

SUMMARY OF THE DISCLOSURE

Disclosed is a hinge comprising two pivoting elements adapted to hingedly join two articles, each pivoting element including attachment means for attaching to an article; wherein when attached to the two articles the hinge is rotatable with respect to the articles.

In one form the hinge is rotatable with respect to the articles such that the direction of freedom of movement of the hinge is changed In one form the hinge further comprises a hinge pin.

In one form the attachment means comprises a hinge collar adapted to be attached to one of the two articles, wherein the hinge is rotatable with respect to the hinge collar.

In one form the axis of rotation of the pivoting elements and the axis of rotation of the hinge are perpendicular to one another.

In one form the hinge is rotatable between a locked position and an unlocked position

BRIEF DESCRIPTION OF THE DRAWINGS

To facilitate an understanding of the disclosure, reference is made in the description to the accompanying drawings illustrating a preferred embodiment of the hinge used in a folding chess board. It is to be understood that the hinge is not limited to the preferred embodiment as illustrated in the drawings.

In the drawings.

DETAILED DESCRIPTION OF THE EMBODIMENTS

Figure 1:
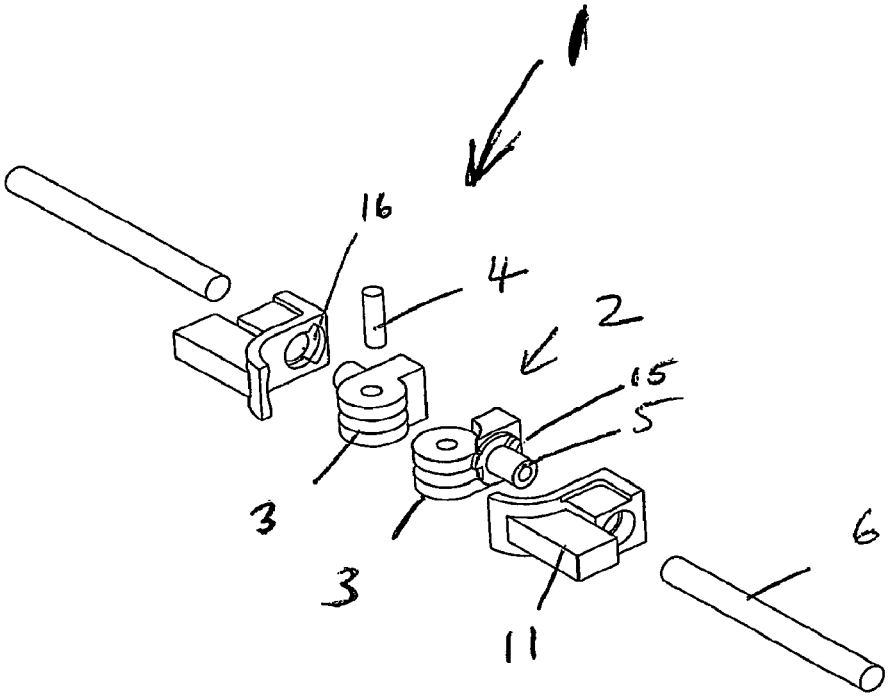
FIG. 1 is an exploded perspective view of the hinge of one embodiment of the present invention.
Figure 2:
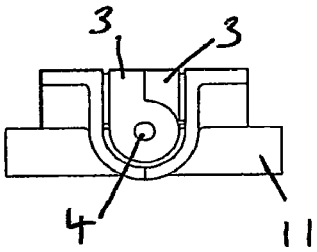
FIG. 2 is a front view of the hinge of FIG. 1 without attachment means.
Figure 3:
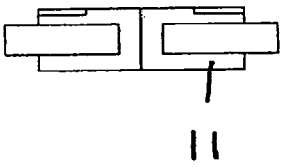
FIG. 3 is a top view of the hinge of FIG. 2.
Figure 4:
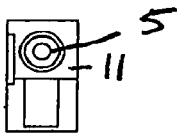
FIG. 4 is a side elevation view of the hinge of FIG. 2.
Figure 5:
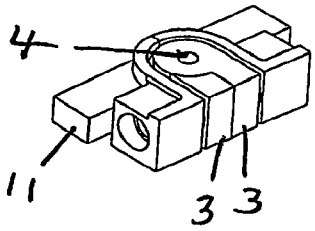
FIG. 5 is a perspective view of the hinge of FIG. 2.
Figure 6:
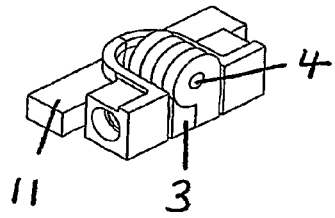
FIG. 6 is a perspective view of the hinge of FIG. 2 with the hinge element in a second position.
Figure 7:
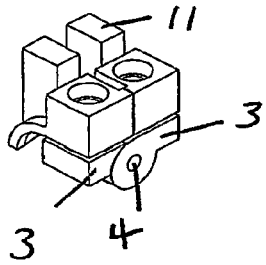
FIG. 7 is a perspective view of the hinge of FIG. 2 with the collar in a second position.
Figure 8:
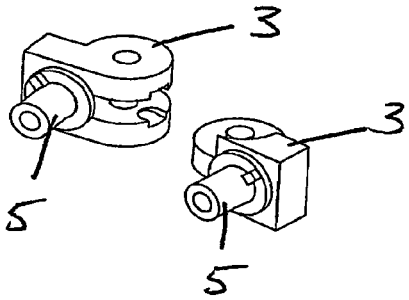
FIG. 8 is an exploded perspective view of the hinge of FIG. 1.
Figure 9:
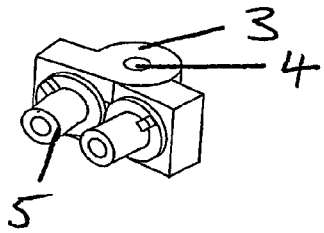
FIG. 9 is a perspective view of the hinge of FIG. 8 in a first position.
Figure 10:
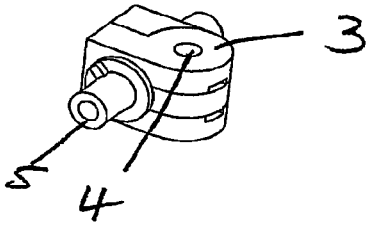
FIG. 10 is a perspective view of the hinge of FIG. 8 in a second position.
Figure 11:
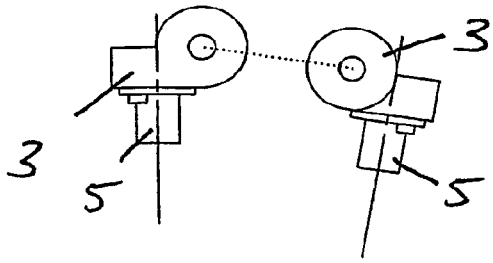
FIG. 11 is a side exploded view of the hinge of FIG. 8.
Figure 12:
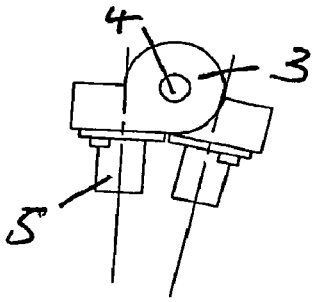
FIG. 12 is a side view of the hinge of FIG. 8 in a first position.
Figure 13:
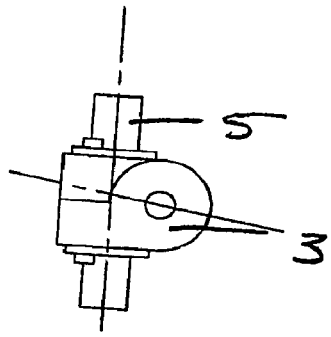
FIG. 13 is a side view of the hinge of FIG. 8 in a second position.
Figure 14:
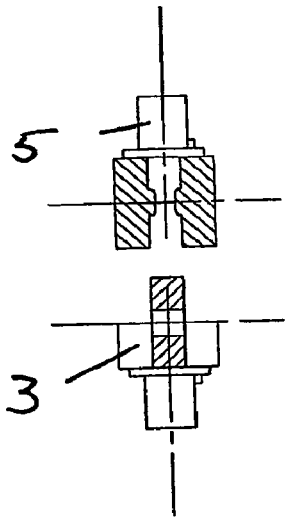
FIG. 14 is a cross-sectional exploded side view of a hinge element of a second embodiment of the invention.
Figure 15:
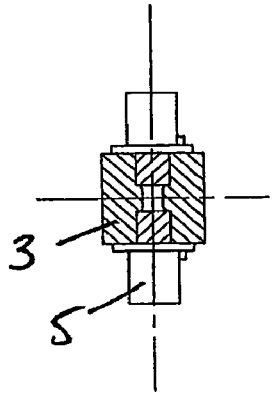
FIG. 15 is a cross-sectional side view of the hinge of FIG. 14.
Figure 16:
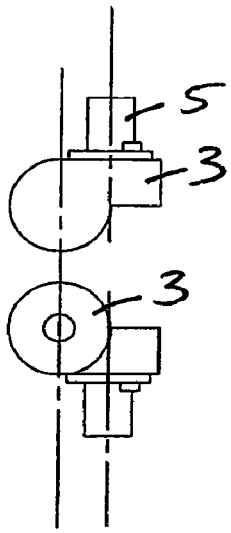
FIG. 16 is an exploded front view of the hinge of FIG. 14.
Figure 17:
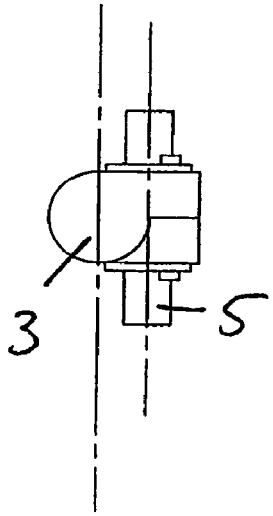
FIG. 17 is a front view of the hinge of FIG. 14.
Figure 18:
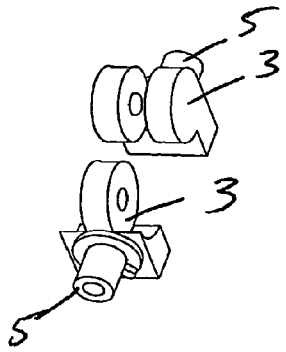
FIG. 18 is an exploded perspective view of the hinge of FIG. 14.
Figure 19:
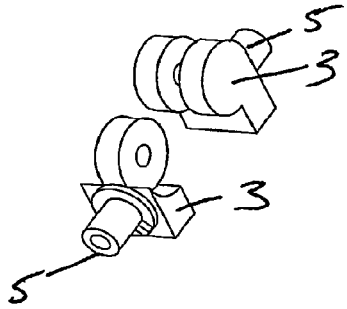
FIG. 19 is an exploded perspective view of the hinge of FIG. 14.
Figure 20:
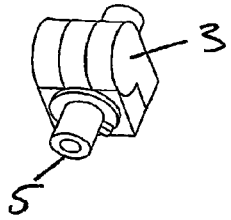
FIG. 20 is a perspective view of the hinge of FIG. 14.
Figure 21:
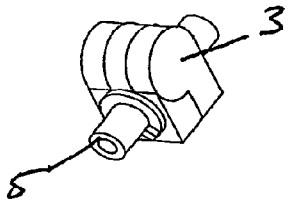
FIG. 21 is a perspective view of the hinge of FIG. 14.

Referring to the figures, there is shown a hinge 1 for allowing a relative motion between two solid articles. In the embodiment shown in the figures the solid articles are in the form of two chess board halves 30.

The hinge 1 comprises two pivoting elements 3. Each of the two independent pivoting elements 3 is attached to a hinge pin 4 such that at least one of the two independent pivoting elements is rotatable about the hinge pin 4. The two independent pivoting elements 3 are therefore rotatable in respect of one another.

Each of the two pivoting elements 3 further comprise a rotatable attachment means including connector 5, shaft 6 and collar 11.

The two pivoting elements 3 are moveable with respect to one another. As a result articles 30 attached with the pivoting elements 3 are moveable with respect to one another.

Figure 22:
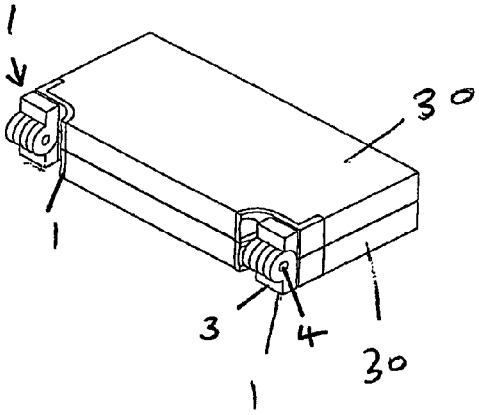
FIG. 22 is a perspective view of the hinge of one embodiment of the present invention in use.
Figure 23:
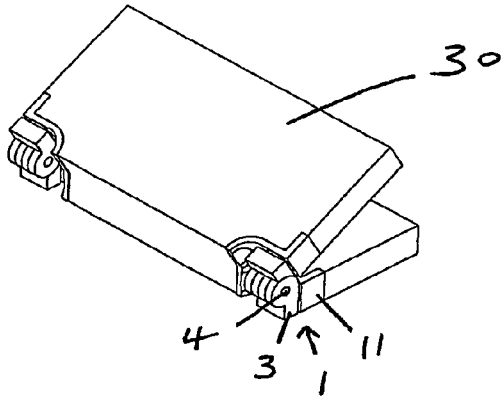
FIG. 23 is a perspective view of the hinge of FIG. 22 in use in a second position.
Figure 24:
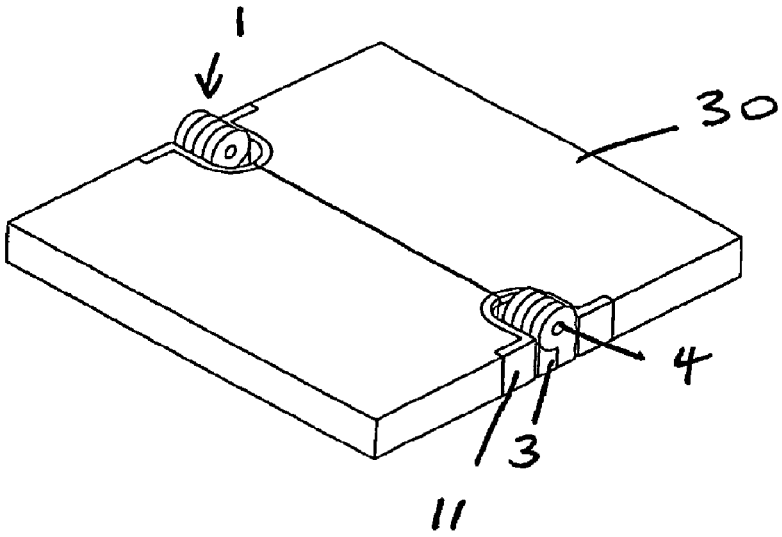
FIG. 24 is a perspective view of the hinge of FIG. 22 in use in a third position.
Figure 25:
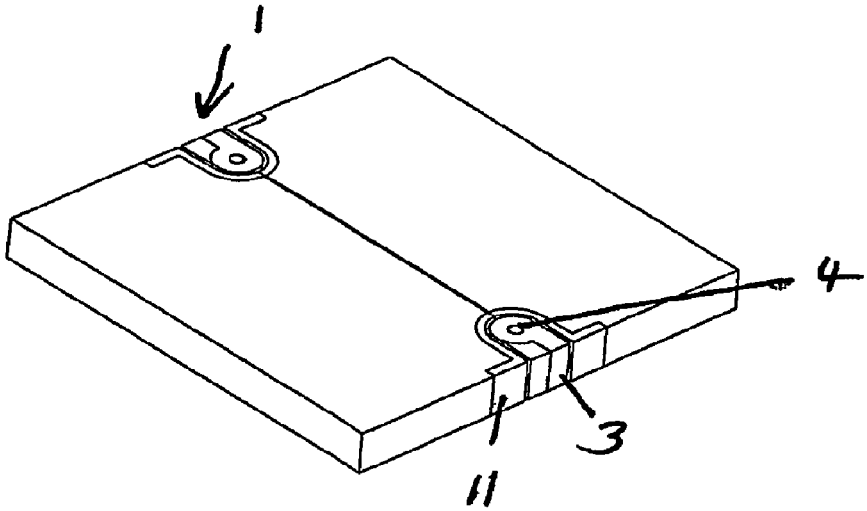
FIG. 25 is a perspective view of the hinge of FIG. 22 in use in a fourth position.

The connectors 5 are adapted to be fitted into the two solid articles 30, such that the two solid articles 30 extend outwardly from the connectors 5. As seen in FIGS. 22 through 25, in this form movement of the pivoting elements 3 brings the two solid articles 30 from a parallel and adjacent position as shown in FIG. 22 to a colinear position as shown in FIG. 25.

The shaft 6 adds strength and length to the hinge 1 to bear the load of the solid articles 30 beyond the pivoting elements 3.

Each hinge collar 11 is adapted to be rotatably attached with connector 5. Shaft 6 is provided with a screw thread or other means to engage with connector 5. Hinge collar 11 is positioned about shaft 6 or connector 5. The hinge 1 and connectors 5 can thus rotate with respect to the collars 11. The collars 11 are shaped to curve over the hinge element but can be any shape.

Figure 26:
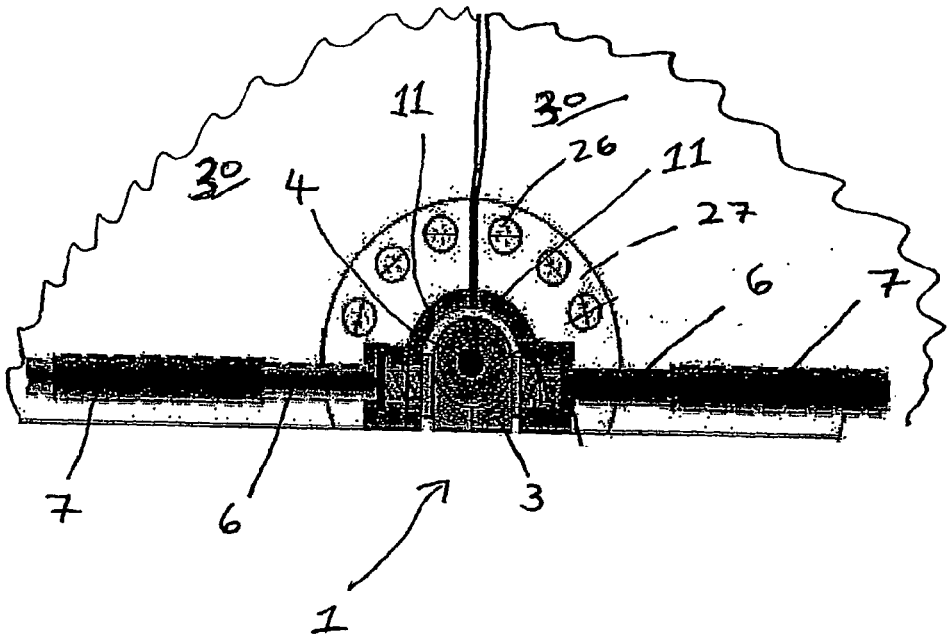
FIG. 26 is a cross-sectional top view of an embodiment of the hinge in locked position in use.
Figure 27:
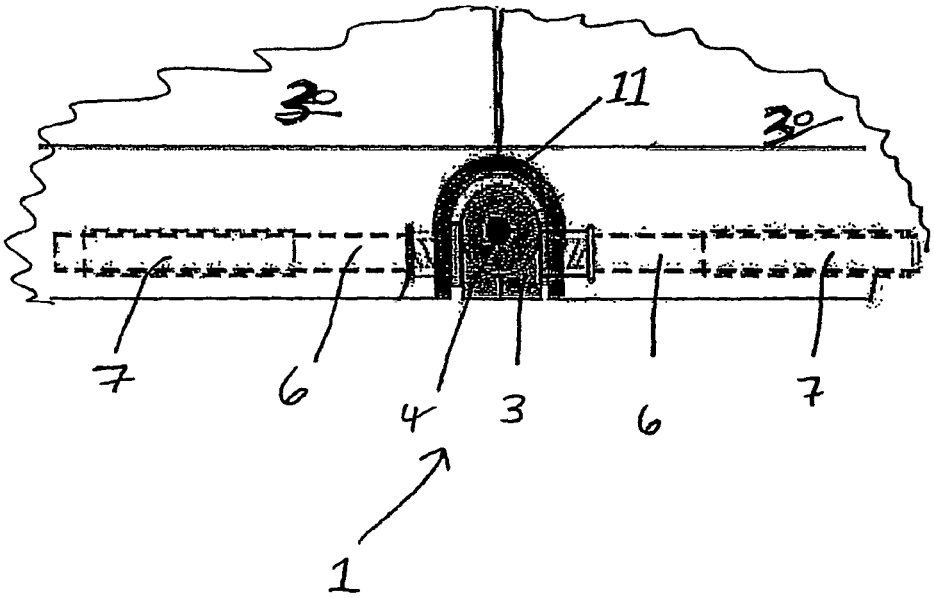
FIG. 27 is a cross sectional bottom view of the hinge of FIG. 26.

As shown in FIGS. 26 and 27, the hinge collar 11 is attached to the solid articles 30 by way of set screws or other attachment means 26 and 27. Each shaft 6 sits in a bearing tube 7 inset into each solid article 30. Shaft 6 is able to rotate in bearing tube 7. The hinge 1 and the connectors 5 are thus rotatable with respect to the solid articles 30 about the axis of the shafts 6.

The hinge 1 is rotatable such that the direction of freedom of movement of the pivoting elements 3 with respect to the solid articles 30 is changed. This change in the direction of freedom of movement of the pivoting elements 3 with respect to the solid articles 30 allows the solid articles 30 to move in varying planes with respect to one another.

In effect, the pivoting elements 3 move such that the hinge pin 4 acts as an axis of rotation. When the hinge 1 is rotated through 90 degrees, the hinge pin 4 and the pivoting elements' 3 axis of rotation is rotated through 90 degrees. As a result the freedom of movement of the hinge is shifted through 90 degrees. Depending upon the size and shape of the solid articles 30 this results in the solid articles being moveable with respect to one another in a different plane or, in certain circumstances means the hinge 1 and pivoting elements 3 are locked so that the solid articles 30 cannot move with respect to one another. That is the hinge 1 is in a locked position.

The locked and unlocked hinge positions are best shown in use in a flat solid article such as two chess board halves. This is best shown in FIGS. 22 through 25.

In the locked position shown in FIG. 25, the orientation of the hinge 1 with respect to the solid articles 30 restricts the movement of the pivoting elements 3 with respect to one another. In the locked position the axis of rotation of the pivoting elements 3 is perpendicular to the only available axis of rotation of the solid articles 30. As a result the solid articles 30 are fixed in position in relation to one another.

The collar 11 is attached to or set into the articles 30 being hinged. Each collar 11 is inset on one side of the ridge 15 extending between the articles 30. Because the collar 11 is set into the two articles 30 the hinge 1 can be flush with the articles 30.

In use, in order to unlock the hinge 1, a user rotates the hinge 1 with respect to the articles 30. This rotates the connectors 5 and connecting shafts 6 in relation to the articles 30. The collar 11, on the other hand, is fixed with respect to the articles 30. The hinge element 2 can be rotated with respect to the articles 30.

The hinge can be rotated 90 degrees. A ridge 15 associated with the connectors 5 and an inset portion 16 associated with the collar interact to stop the hinge 1 from rotating an angle greater than 90 degrees.

In other forms the hinge can be rotated through up to 360 degrees by incorporating a ridge which interacts to stop the hinge from rotating more than 180 degrees, 270 degrees or any angle. When no ridge is incorporated the hinge can be rotated 360 degrees. When the hinge can be rotated through 360 degrees the direction of freedom of movement can be rotated through 360 degrees, allowing the solid articles 30 to move in varying planes with respect to one another.

In use, the position of the hinge 1 in the hinged article and the opening movement of the hinge 1 prevents the meeting of the articles 30 joined by the hinge 1 along the ridge 15. There is therefore no crunching or grinding or opportunity of wear between chess board halves along the ridge 15.

Further, the hinge 1 allows for no hyperextension beyond the position determined as the home position. When the connectors 5 are collinear to one another the pivoting elements 3 meet to prevent hyperextension of the hinge 1.

The collar 11 and hinge element 2 allows for staged fitting, whereby the collar 11 is attached to the hinged article. Subsequently the hinge element is attached.

The hinge element 2 is composed of metal, plastic or any other rigid durable substance.

In another embodiment, the centre of gravity of the hinge element is positioned such that gravity is utilised to automate the rotation of the hinge element 2 within the collar. In another form the rotation of the hinge is actuated automatically by a motor, spring, magnet or other external means.

In the embodiment described above, the two solid articles 30 comprise chess board halves. In other embodiments the two solid articles 30 may comprise any two solid articles requiring movement in respect to one another, for example scaffolding, flooring, two panels of an articulated dividing screen, a board game board, cupboard doors, and advertising panels.

The invention claimed is:

1. A hinge comprising two pivoting elements, wherein each pivoting element is configured to attach to a first article and a second article, such that the first and second articles are attached to the two pivoting elements, respectively; and the pivoting elements and first and second articles move between a first position and a second position, wherein, in the first position, the first and second articles are parallel and adjacent and rotatable about a first axis from the first position to the second position, and wherein, in the second position, the first and second articles are colinear and the pivoting elements are rotatable about a second axis while the first and second articles remain colinear, wherein the second axis is different than the first axis.

2. A hinge as defined in claim 1, wherein the hinge further comprises a hinge pin.

3. A hinge as defined in claim 1, further comprising a hinge collar that is adapted to be attached to one of the two articles and the hinge is rotatable with respect to the hinge collar.

4. A hinge as defined in claim 1, wherein the first and second axis are perpendicular to one another.

5. A hinge as defined in claim 1 further comprising a shaft extending from each pivoting element.

6. A hinge as defined in claim 1, wherein, in the second position, rotation of the hinge about the second axis moves the hinge between a locked position and an unlocked position.

7. A hinge as defined in claim 1 further comprising an attachment means for attaching the pivoting element to each article.

8. The hinge of claim 7, wherein the attachment means comprises a hinge collar for each pivoting element.

* * * * *